US008542165B2

(12) United States Patent
Choi

(10) Patent No.: US 8,542,165 B2
(45) Date of Patent: Sep. 24, 2013

(54) ORGANIC LIGHT EMITTING DISPLAY

(75) Inventor: Sang-Moo Choi, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 272 days.

(21) Appl. No.: 12/944,612

(22) Filed: Nov. 11, 2010

(65) Prior Publication Data

US 2011/0227908 A1 Sep. 22, 2011

(30) Foreign Application Priority Data

Mar. 17, 2010 (KR) ..... 10-2010-0023759

(51) Int. Cl.
*G09G 3/30* (2006.01)

(52) U.S. Cl.
USPC ..... 345/76; 345/82

(58) Field of Classification Search
USPC ..... 345/76, 77, 83
See application file for complete search history.

(56) References Cited

U.S. PATENT DOCUMENTS

| | | | | |
|---|---|---|---|---|
| 7,414,599 | B2 * | 8/2008 | Chung et al. | 345/76 |
| 2006/0139257 | A1 * | 6/2006 | Kwak et al. | 345/76 |
| 2006/0139266 | A1 * | 6/2006 | Choi | 345/77 |
| 2009/0243977 | A1 * | 10/2009 | Chung | 345/76 |
| 2010/0141645 | A1 * | 6/2010 | Choi et al. | 345/214 |

FOREIGN PATENT DOCUMENTS

| | | | |
|---|---|---|---|
| KR | 10-2005-0050242 | A | 5/2005 |
| KR | 10-2006-0093954 | A | 8/2006 |
| KR | 10-2007-0016845 | | 2/2007 |
| KR | 10-2007-0083072 | | 8/2007 |
| KR | 10-0911980 | B1 | 8/2009 |
| KR | 10-0926635 | B1 | 11/2009 |

OTHER PUBLICATIONS

KIPO Office Action dated Aug. 16, 2011 for KR Application No. 10-2010-0023759 (1 page).

* cited by examiner

*Primary Examiner* — Chanh Nguyen
*Assistant Examiner* — Roy Rabindranath
(74) *Attorney, Agent, or Firm* — Christie, Parker & Hale, LLP

(57) ABSTRACT

An organic light emitting display includes a scan driver configured to supply scan signals to scan lines and to supply emission control signals to emission control lines, a data driver configured to supply data signals and an initialization voltage to data lines, and pixels positioned at crossing regions of the scan lines and the data lines, each of the pixels comprising an organic light emitting diode (OLED) and a first transistor for controlling an amount of current supplied from a first power source and having a second electrode coupled to the first power source and a first electrode coupled to the OLED, wherein a gate electrode of the first transistor of a first pixel from among the pixels positioned on an $i^{th}$ ("i" is a positive integer) horizontal line is coupled to a corresponding one of the data lines via a second pixel from among the pixels positioned on an $(i-1)^{th}$ horizontal line in a period where the initialization voltage is supplied to the data lines.

15 Claims, 3 Drawing Sheets

ORGANIC LIGHT EMITTING DISPLAY

CROSS-REFERENCE TO RELATED APPLICATION

This application claims priority to and the benefit of Korean Patent Application No. 10-2010-0023759, filed on Mar. 17, 2010, in the Korean Intellectual Property Office, the entire content of which is incorporated herein by reference.

BACKGROUND

1. Field

An aspect according to embodiments of the present invention relates to an organic light emitting display.

2. Description of Related Art

Recently, there have been developed various types of flat panel display devices (FPDs) having reduced weight and volume to address disadvantages of cathode ray tubes (CRTs). The FPDs include liquid crystal display devices (LCDs), field emission display devices (FEDs), plasma display panels (PDPs), organic light emitting display devices, and the like.

Among these flat panel display devices, the organic light emitting display device displays images using organic light emitting diodes that emit light through the recombination of electrons and holes. The organic light emitting display has the advantages of a high response speed while being driven with low power consumption.

The organic light emitting display includes a plurality of pixels arranged at crossing regions of data lines and scan lines, such as in the form of a matrix. In general, each of the pixels includes an organic light emitting diode (OLED), at least two transistors, and at least one capacitor.

In an organic light emitting display, an amount of current that flows to the OLED varies with the threshold voltage variation of the driving transistor included in each of the pixels, and non-uniform displaying may therefore occur. That is, properties of the driving transistors in each of the pixels vary according to the manufacturing process of the driving transistors, as it is very difficult to manufacture transistors having identical properties using current manufacturing technologies. Therefore, threshold voltage variation of the driving transistors occurs.

SUMMARY

An aspect of embodiments according to the present invention provides an organic light emitting display capable of simplifying a wiring line structure and also capable of minimizing or reducing leakage current.

In order to achieve the foregoing and/or other aspects of embodiments according to the present invention, according to one embodiment of the present invention, there is provided an organic light emitting display including a scan driver configured to supply scan signals to scan lines and to supply emission control signals to emission control lines, a data driver configured to supply data signals and an initialization voltage to data lines, and pixels positioned at crossing regions of the scan lines and the data lines, each of the pixels including an organic light emitting diode (OLED) and a first transistor for controlling an amount of current supplied from a first power source and having a second electrode coupled to the first power source and a first electrode coupled to the OLED, wherein a gate electrode of the first transistor of a first pixel from among the pixels positioned on an $i^{th}$ ("i" is a positive integer) horizontal line is coupled to a corresponding one of the data lines via a second pixel from among the pixels positioned on an $(i-1)^{th}$ horizontal line in a period where the initialization voltage is supplied to the data lines.

The first pixel may be configured to receive the initialization voltage through the second pixel in a period in which the data driver is configured to supply the initialization voltage to the data lines.

The first pixel may further include a second transistor coupled between the first electrode of the first transistor and the corresponding one of the data lines and configured to be turned on when a corresponding one of the scan signals is supplied to an $i^{th}$ scan line of the scan lines, a third transistor coupled between the second electrode of the first transistor and the gate electrode of the first transistor and configured to be turned on when the corresponding one of the scan signals is supplied to the $i^{th}$ scan line, a storage capacitor coupled between the first power source and the gate electrode of the first transistor, and a fourth transistor coupled between the first electrode of the first transistor and a pixel positioned on an $(i+1)^{th}$ horizontal line and configured to be turned on when the corresponding one of the scan signals is supplied to the $i^{th}$ scan line.

The fourth transistor may be coupled to the gate electrode of the first transistor of the pixel positioned on the $(i+1)^{th}$ horizontal line.

The first pixel may further include a fifth transistor coupled between the first electrode of the first transistor and the first power source and configured to be turned off when a corresponding one of the emission control signals is supplied to an $i^{th}$ emission control line of the emission control lines, and a sixth transistor coupled between the second electrode of the first transistor and the OLED and configured to be turned off when the corresponding one of the emission control signals is supplied to the $i^{th}$ emission control line.

A supply of the corresponding one of the emission control signals to the $i^{th}$ emission control line may overlap the scan signals supplied to the $i^{th}$ scan line and an $(i-1)^{th}$ scan line of the scan lines.

The scan driver may be configured to supply the scan signals to the scan lines during a period and the data driver may be configured to supply the data signals and the initialization voltage to the data lines during the period.

The gate electrode of the first transistor of the first pixel may be electrically coupled to the corresponding one of the data lines via the second pixel during a first portion of the period where the initialization voltage is supplied to the data lines.

The period may be divided into a first period and a second period, the data signals may be supplied to the data lines in the first period, and the initialization voltage may be supplied to the data lines in the second period.

The initialization voltage may be lower than a voltage of the data signals.

The scan signals supplied to an $(i-1)^{th}$ scan line and an $i^{th}$ scan line of the scan lines may overlap.

The initialization voltage may be supplied to the data lines in a first period where the scan signals overlap and the data signals may be supplied to the data lines in a second period where the scan signals do not overlap.

The second period may be longer in duration than the first period.

The initialization voltage may be supplied to the data lines in a first period where the scan signals supplied to the $(i-1)^{th}$ scan line and the $i^{th}$ scan line overlap and the data signals may be supplied to the data lines in a second period where the scan signals supplied to the $(i-1)^{th}$ scan line and the $i^{th}$ scan line do not overlap.

The second period may be greater than the first period.

In the organic light emitting display according to embodiments of the present invention, a driving transistor is initialized using an initialization voltage supplied to data lines so that an initialization line may be omitted. Additionally, the gate electrode of the driving transistor according to embodiments of the present invention forms a current path through which current is received and a current path through which current leaks so that a voltage change in the electrode of the driving transistor may be reduced or minimized.

BRIEF DESCRIPTION OF THE DRAWINGS

The accompanying drawings, together with the specification, illustrate exemplary embodiments of the present invention, and, together with the description, serve to explain the principles of embodiments of the present invention.

DETAILED DESCRIPTION

Figure 1:
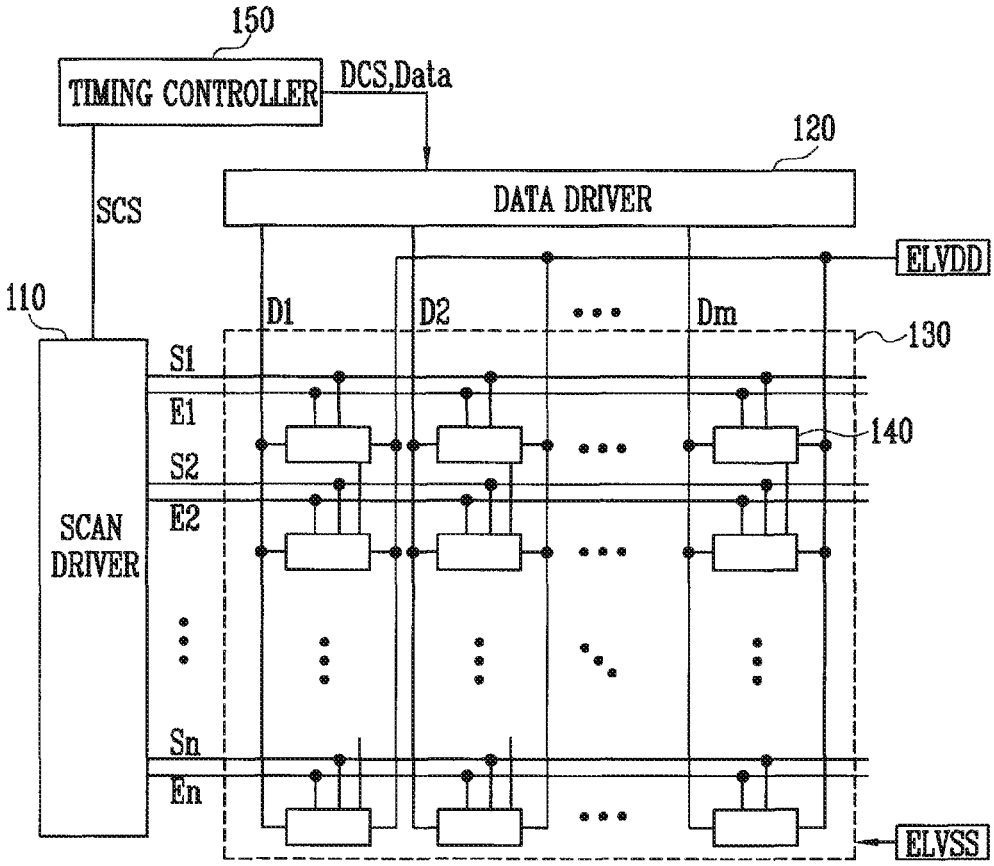
FIG. 1 is a schematic diagram illustrating an organic light emitting display according to an embodiment of the present invention.

In order to solve the aforementioned problems, a pixel including six transistors and at least one capacitor was suggested in Korean Patent Publication No. 2007-0083072. However, the pixel suggested has a complicated wiring line structure due to the presence of an initialization line coupled to an initialization power source for initializing a driving transistor. Furthermore, a leakage path extending from the gate electrode of the driving transistor to the initialization power source and an OLED is formed, thereby adversely affecting the displayed image.

Hereinafter, certain exemplary embodiments according to the present invention will be described with reference to the accompanying drawings. Here, when a first element is described as being coupled to a second element, the first element may be directly coupled to the second element or indirectly coupled to the second element via one or more other elements. Further, some of the elements that are not essential to a complete understanding of the invention are omitted for clarity. The embodiments of the present invention may have different forms and should not be construed as being limited to the descriptions set forth herein. Also, like reference numerals refer to like elements throughout. Hereinafter, exemplary embodiments of the present invention are described in detail with reference to FIGS. 1 to 4 to explain aspects of embodiments according to the present invention.

FIG. 1 is a schematic diagram illustrating an organic light emitting display according to an embodiment of the present invention.

Referring to FIG. 1, the organic light emitting display according to one embodiment of the present invention includes a display unit 130 having pixels 140 coupled to scan lines S1 to Sn and data lines D1 to Dm, a scan driver 110 configured to drive the scan lines S1 to Sn and emission control lines E1 to En, a data driver 120 configured to drive the data lines D1 to Dm, and a timing controller 150 configured to control the scan driver 110 and the data driver 120.

The scan driver 110 receives scan driving control signals SCS from the timing controller 150 and then generates scan signals and supplies (e.g., sequentially supplies) the generated scan signals to the scan lines S1 to Sn. In addition, the scan driver 110 generates emission control signals in response to the scan driving control signals SCS and supplies (e.g., sequentially supplies) the generated emission control signals to the emission control lines E1 to En. In one embodiment, the emission control signal supplied to the $i^{th}$ ("i" is a positive integer) emission control line Ei overlaps in time with the scan signals supplied to the $(i-1)^{th}$ scan line Si−1 and the $i^{th}$ scan line Si.

The data driver 120 receives data driving control signals DCS from the timing controller 150, and supplies the data signals to the data lines D1 to Dm for a first period while the scan signals are supplied and supplies an initialization voltage in a second period while the scan signals are supplied. The first period may be set to be larger than the second period, and the two periods may be separate.

The timing controller 150 generates the data driving control signals DCS and the scan driving control signals SCS to correspond to externally supplied synchronization signals and supplies the data driving control signals DCS to the data driver 120 and the scan driving control signals SCS to the scan driver 110. The timing controller 150 supplies data Data, which may be externally supplied to the timing controller 150, to the data driver 120.

The display unit 130 receives a first power from a first power source ELVDD (e.g., an external first power source ELVDD) and a second power from a second power source ELVSS (e.g., an external second power source ELVSS) to supply the first and second powers to the pixels 140, which generate light (e.g., with predetermined brightness) while controlling the amount of current that flows from the first power source ELVDD to the second power source ELVSS via OLEDs corresponding to the data signals.

A pixel 140 positioned on an $i^{th}$ horizontal line receives the initialization power (e.g., initialization voltage) from the data line (one of D1 to Dm) via another pixel 140 positioned on an $(i-1)^{th}$ horizontal line and initializes the gate electrode voltage of a driving transistor using the received initialization power. Therefore, dummy pixels may be additionally formed on a line preceding the scan line S1.

Figure 2:
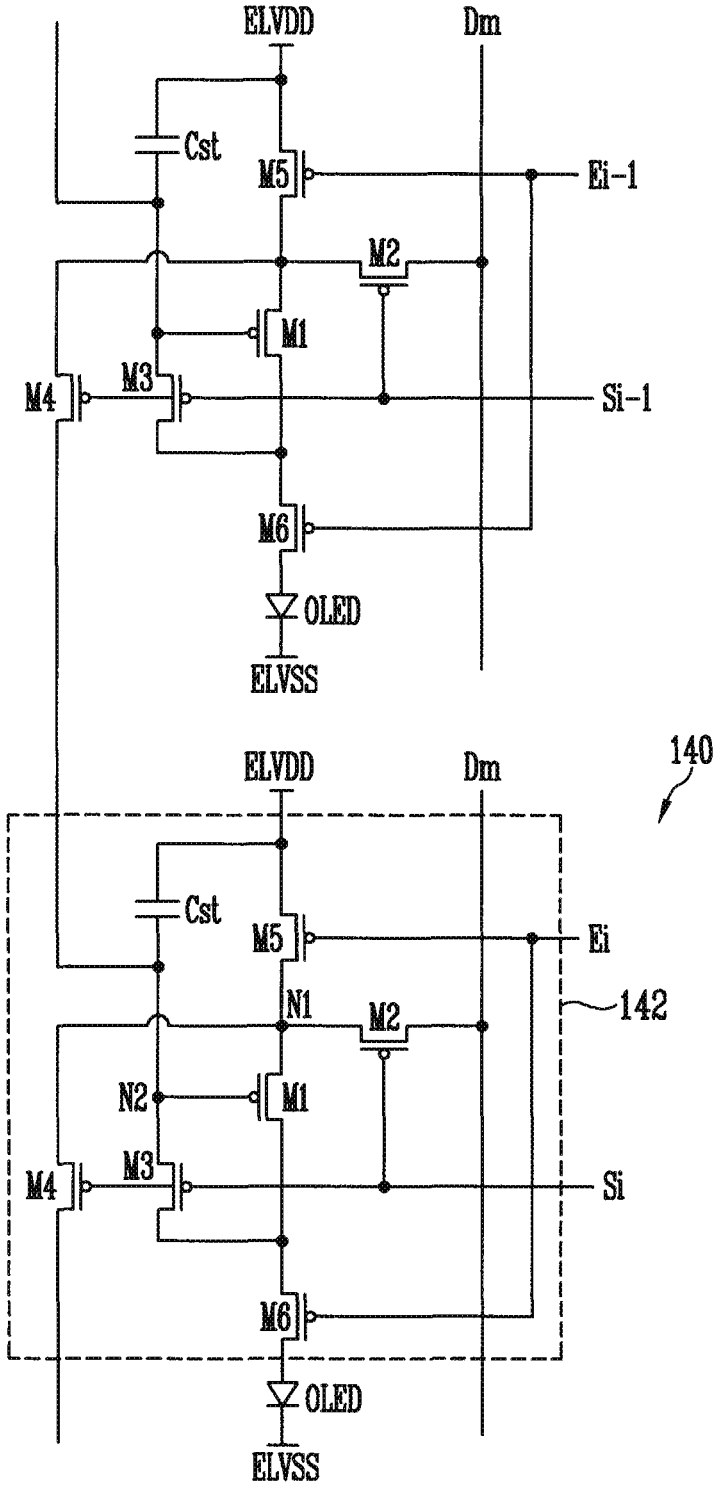
FIG. 2 is a circuit diagram illustrating an embodiment of a pixel shown in FIG. 1.

FIG. 2 is a circuit diagram illustrating a pixel of an embodiment according to the present invention shown in FIG. 1. In FIG. 2, the pixels 140 positioned on the $i^{th}$ horizontal line and the $(i-1)^{th}$ horizontal line are illustrated and will be described with reference to the pixel 140 positioned on the $i^{th}$ horizontal line.

Referring to FIG. 2, the pixel 140 according to one embodiment of the present invention includes an OLED and a pixel circuit 142 coupled to the data line Dm, the scan line S1, and the emission control line E1 to control the amount of current supplied to the OLED.

The anode electrode of the OLED is coupled to the pixel circuit 142 and the cathode electrode of the OLED is coupled to the second power source ELVSS. The OLED generates light (e.g., generates light with predetermined brightness) corresponding to the amount of current supplied from the first power source ELVDD via the pixel circuit 142.

The pixel circuit 142 initializes the gate electrode of a driving transistor (first transistor M1) using an initialization power supplied from the data line Dm and also receives a data signal from the data line Dm. The pixel circuit 142 controls the amount of current supplied to the OLED corresponding to the data signal. Therefore, the pixel circuit 142 further includes a second transistor M2, a third transistor M3, a fourth transistor M4, a fifth transistor M5, a sixth transistor M6 (each transistor having a first electrode, a second electrode, and a gate electrode), and a storage capacitor Cst.

The first electrode of the second transistor M2 is coupled to the first data line Dm, and the second electrode of the second transistor M2 is coupled to a first node N1. The gate electrode of the second transistor M2 is coupled to the $i^{th}$ scan line Si, and is turned on when the scan signal is supplied to the $i^{th}$ scan line Si to supply the data signal and the initialization voltage from the data line Dm to the first node N1.

The first electrode of the first transistor M1 is coupled to the first node N1, and the second electrode of the first transistor M1 is coupled to the first electrode of the sixth transistor M6. The gate electrode of the first transistor M1 is coupled to a second node N2, which is also coupled to one terminal of the storage capacitor Cst. The first transistor M1 supplies current corresponding to a voltage charged in the storage capacitor Cst to the OLED.

The first electrode of the third transistor M3 is coupled to the second electrode of the first transistor M1, and the second electrode of the third transistor M3 is coupled to the second node N2. The gate electrode of the third transistor M3 is coupled to the $i^{th}$ scan line Si. The third transistor M3 is turned on when the scan signal is supplied to the $i^{th}$ scan line Si to couple the first transistor M1 in the form of a diode (e.g., the first transistor M1 is diode-connected).

The gate electrode of the fourth transistor M4 is coupled to the $i^{th}$ scan line Si and the first electrode of the fourth transistor M4 is coupled to the first node N1. The second electrode of the fourth transistor M4 is coupled to the second node of a pixel positioned on an $(i+1)^{th}$ horizontal line (not shown), and the second node N2 of the pixel 140 positioned on the $i^{th}$ horizontal line is coupled to the fourth transistor M4 of the pixel 140 positioned on an $(i-1)^{th}$ horizontal line. The fourth transistor M4 is turned on when the scan signal is supplied to the $i^{th}$ scan line Si.

The first electrode of the fifth transistor M5 is coupled to the first power source ELVDD, and the second electrode of the fifth transistor M5 is coupled to the first node N1. The gate electrode of the fifth transistor M5 is coupled to the emission control line Ei, and is turned off when an emission control signal is supplied from the emission control line Ei and is turned on when the emission control signal is not supplied. When the fifth transistor M5 is turned on, the first power source ELVDD and the first node N1 are electrically coupled to each other.

The second electrode of the sixth transistor M6 is coupled to the anode electrode of the OLED. The gate electrode of the sixth transistor M6 is coupled to the emission control line Ei, and is turned off when an emission control signal is supplied from the emission control line Ei and is turned on when the emission control signal is not supplied. When the sixth transistor M6 is turned on, the OLED and the first transistor M1 are electrically coupled to each other.

The storage capacitor Cst is coupled between the second node N2 and the first power source ELVDD, and charges a voltage corresponding to the data signal.

Figure 3:
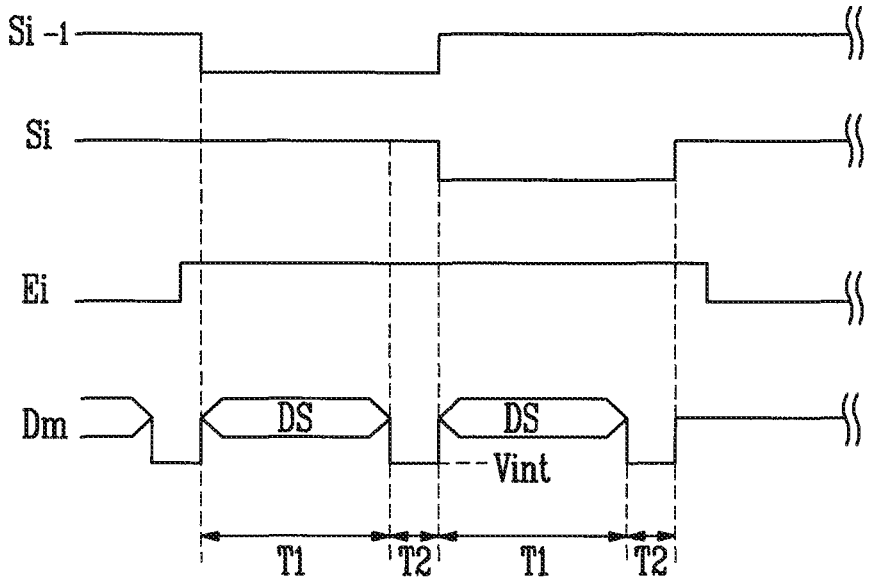
FIG. 3 is a waveform diagram illustrating a driving method according to a first embodiment of the present invention.

FIG. 3 is a waveform diagram illustrating a driving method according to a first embodiment of the present invention.

Referring to FIGS. 2 and 3, in a period where scan signals are supplied to the $(i-1)^{th}$ scan line Si−1 and the $i^{th}$ scan line Si, an emission control signal is supplied to the $i^{th}$ emission control line Ei so that the fifth transistor M5 and the sixth transistor M6 are turned off.

When the fifth transistor M5 is turned off, the first power source ELVDD and the first node N1 are electrically decoupled from each other. When the sixth transistor M6 is turned off, the first transistor M1 and the OLED are electrically decoupled from each other. Therefore, in a period where the emission control signal is supplied to the $i^{th}$ emission control line Ei, the pixel 140 positioned on the $i^{111}$ horizontal line is in a non-emission state.

Then, while a scan signal is supplied to the $(i-1)^{th}$ scan line Si−1, a data signal DS is supplied to the data line Dm in the first period T1 and the initialization voltage Vint (e.g., initialization power) is supplied to the data line Dm in the second period T2.

When the scan signal is supplied to the $(i-1)^{th}$ scan line Si−1, the second transistor M2, the third transistor M3, and the fourth transistor M4 are turned on. Therefore, in the period where the scan signal is supplied to the $(i-1)^{th}$ scan line Si−1, the initialization voltage Vint (e.g., initialization power) supplied to the data line Dm in the second period T2 is supplied to the second node N2 of the pixel 140 positioned on the $i^{th}$ horizontal line. At this time, the second node N2 of the pixel 140 positioned on the $i^{th}$ horizontal line is initialized to the initialization voltage Vint. The initialization voltage Vint may be lower than a voltage of the data signal, for example, lower than the voltage obtained by subtracting the threshold voltage of the first transistor M1 from the voltage of the data signal.

Then, the scan signal is supplied to the $i^{th}$ scan line Si so that the second transistor M2, the third transistor M3, and the fourth transistor M4 positioned on the $i^{th}$ horizontal line may be turned on. In the period where the scan signal is supplied to the $i^{th}$ scan line Si, the data signal DS is supplied to the data line Dm in the first period T1. The data signal DS supplied to the data line Dm is supplied to the first node N1 via the second transistor M2.

Since the first transistor M1 is coupled in the form of a diode (i.e., the first transistor M1 is diode-coupled), and since the second node N2 is initialized to the initialization voltage Vint, the voltage applied to the first node N1 is supplied to the second node N2 via the first transistor M1 in the form of a diode. At this time, the voltage of the second node N2 is set to a voltage having a value obtained by subtracting the threshold voltage of the first transistor M1 from the voltage of the data signal. In the first period T1, the storage capacitor Cst charges the voltage applied to the second node N2, which is the voltage corresponding to the data signal DS and the threshold voltage of the first transistor M1.

In the period where the scan signal is supplied to the $i^{th}$ scan line Si, during the second period T2, the initialization voltage Vint is supplied to the data line Dm, which is supplied to the pixel positioned on the $(i+1)^{th}$ horizontal line via the second transistor M2 and the fourth transistor M4. Although the initialization voltage Vint is supplied to the first node N1 in the second period T2, the voltage charged in the storage capacitor Cst may be maintained as the voltage charged in the first period T1.

The voltage applied to the second node N2 may be set to be higher than the voltage applied to the first node N1. Since the first transistor M1 is not coupled in the form of a diode, current does not flow from the second node N2 to the first node N1. Therefore, the voltage charged in the storage capacitor Cst may be maintained (e.g., stably maintained).

Supply of the emission control signal to the $i^{th}$ emission control line Ei is then stopped so that the fifth transistor M5 and the sixth transistor M6 are turned on. When the fifth transistor M5 and the sixth transistor M6 are turned on, a current path extending from the first power source ELVDD to the second power source ELVSS via the OLED is formed. The first transistor M1 controls the amount of current supplied to the OLED in accordance with the voltage charged in the storage capacitor Cst.

The pixel 140 according to one embodiment of the present invention supplies an initialization voltage Vint to the data line Dm without using an additional initialization power source for providing an additional initialization voltage. According to one embodiment of the present invention, an additional initialization line otherwise coupled to the initialization power source may be removed so that manufacturing cost may be reduced and a structure may be simplified. In addition, according to one embodiment of the present invention, the leakage current generated by the second node N2 may be reduced or minimized so that an image with desired brightness may be displayed.

The second node N2 included in the pixel 140 positioned on the $i^{th}$ horizontal line is coupled to the OLED via the third transistor M3 and the sixth transistor M6. In this case, partial current may leak from the second node N2 via the third transistor M3 and the sixth transistor M6. However, the second node N2 included in the pixel 140 positioned on the $i^{th}$ horizontal line is coupled to the first power source ELVDD via the fourth transistor M4 and the fifth transistor M5 included in the pixel 140 positioned on the $(i-1)^{th}$ horizontal line. In this case, partial current may be received from the first power source ELVDD via the fourth transistor M4 and the fifth transistor M5. Therefore, the second node N2 may maintain a uniform or substantially uniform voltage by leakage current and received current offsetting (or partially offsetting) one another.

Figure 4:
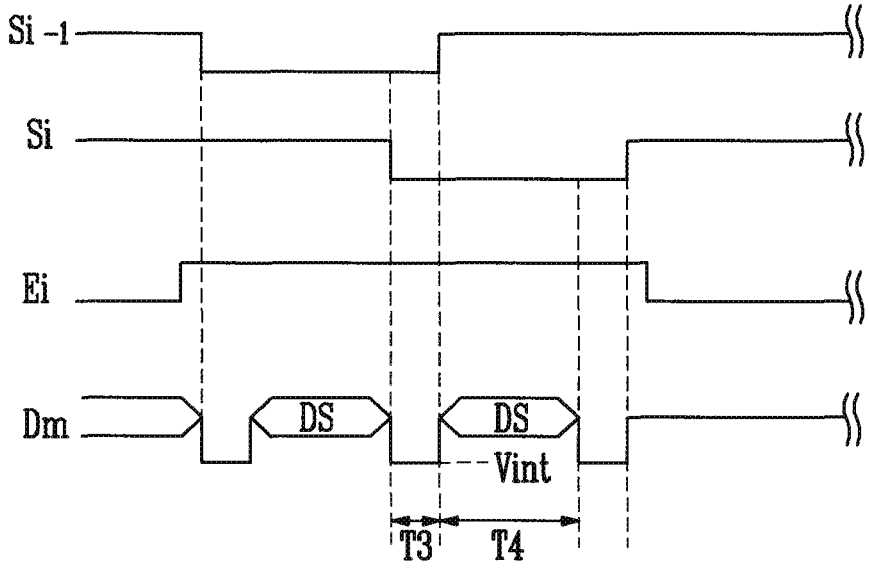
FIG. 4 is a waveform diagram illustrating a driving method according to a second embodiment of the present invention.

FIG. 4 is a waveform diagram illustrating a driving method according to a second embodiment of the present invention.

Referring to FIG. 4, in the driving method according to a second embodiment of the present invention, the $(i-1)^{th}$ scan line Si−1 and the $i^{th}$ scan line Si are supplied to overlap in a partial period T3. That is, a scan signal supplied to a previous scan line and a scan signal supplied to a current scan line overlap in the third period T3. In the third period T3 where the scan signals overlap, the initialization voltage Vint is supplied to the data line Dm. In a fourth period T4 where the scan signals do not overlap in time, the data signal DS is supplied to the data line Dm. The fourth period T4 is set to have a larger width (i.e., be longer in duration) than the third period T3.

In the described embodiment, during the third period T3, the scan signals are supplied to the $(i-1)^{th}$ scan line Si−1 and the $i^{th}$ scan line Si and the initialization voltage Vint is supplied to the data line Dm. When the scan signal is supplied to the $(i-1)^{th}$ scan line Si−1, the second transistor M2, the third transistor M3, and the fourth transistor M4 positioned on the $(i-1)^{th}$ horizontal line are turned on so that the initialization voltage Vint (e.g., initialization power) is supplied to the second node N2 of the pixel 140 positioned on the $i^{th}$ horizontal line.

When the scan signal is supplied to the $i^{th}$ scan line Si, the second transistor M2, third transistor M3, and the fourth transistor M4 positioned on the $i^{th}$ horizontal line are turned on. Therefore, the initialization voltage Vint is supplied to the first node N1 in the third period T3.

Then, in the fourth period T4, supply of the scan signal to the $(i-1)^{th}$ scan line Si−1 is stopped and the data signal DS is supplied to the data line Dm. The data signal DS supplied to the data line Dm is supplied to the first node N1 of the pixel 140 positioned on the $i^{th}$ horizontal line so that a voltage obtained by subtracting the threshold voltage of the first transistor M1 from the voltage of the data signal DS is applied to the second node N2. In the fourth period T4, the storage capacitor Cst charges the voltage corresponding to the data signal DS and the threshold voltage of the first transistor M1.

Then, the scan signal is supplied to the $(i+1)^{th}$ scan line Si+1 to overlap the scan signal supplied to the $i^{th}$ scan line Si so that the initialization voltage Vint is supplied to the second node N2 of the pixel 140 positioned on the $(i+1)^{th}$ horizontal line. Supply of the scan signal to the $i^{th}$ scan line Si and the emission control signal to the $i^{th}$ emission control line Ei is stopped. The first transistor M1 controls the amount of current supplied to the OLED in accordance with the voltage charged in the storage capacitor Cst.

While the present invention has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. An organic light emitting display comprising:

a scan driver configured to supply scan signals to scan lines and to supply emission control signals to emission control lines;

a data driver configured to supply data signals and an initialization voltage to data lines; and pixels positioned at crossing regions of the scan lines and the data lines, each of the pixels comprising:

an organic light emitting diode (OLED);

a first transistor for controlling an amount of current supplied from a first power source, the first transistor having a first electrode coupled to the first power source and a second electrode coupled to the OLED;

a second transistor coupled between the first electrode of the first transistor and a corresponding one of the data lines; and a fourth transistor connected to both of the first and second transistors, the first, second, and fourth transistors being connected to each other directly at a common node, wherein a gate electrode of the first transistor of a first pixel from among the pixels positioned on an $i^{th}$ ("i" is a positive integer) horizontal line is coupled to a corresponding one of the data lines via a second pixel from among the pixels positioned on an $(i-1)^{th}$ horizontal line in a period where the initialization voltage is supplied to the data lines, wherein the fourth transistor of the first pixel is coupled between the first transistor of the first pixel and a third pixel positioned on an $(i+1)^{th}$ horizontal line, and is configured to be turned on by a corresponding one of the scan signals supplied to an $i^{th}$ scan line, and wherein the second transistor of the first pixel is configured to be turned on when a corresponding one of the scan signals is supplied to the $i^{th}$ scan line of the scan lines.

2. The organic light emitting display as claimed in claim 1, wherein the first pixel is configured to receive the initialization voltage through the second pixel in a period in which the data driver is configured to supply the initialization voltage to the data lines.

3. The organic light emitting display as claimed in claim 1 wherein the scan driver is configured to supply the scan signals to the scan lines during a period and the data driver is configured to supply the data signals and the initialization voltage to the data lines during the period.

4. The organic light emitting display as claimed in claim 3, wherein the gate electrode of the first transistor of the first pixel is electrically coupled to the corresponding one of the data lines via the second pixel during a first portion of the period where the initialization voltage is supplied to the data lines.

5. The organic light emitting display as claimed in claim 3, wherein the period is divided into a first period and a second period, the data signals are supplied to the data lines in the first period, and the initialization voltage is supplied to the data lines in the second period.

6. The organic light emitting display as claimed in claim 1, wherein the initialization voltage is lower than a voltage of the data signals.

7. The organic light emitting display as claimed in claim 1, wherein the scan signals supplied to an $(i-1)^{th}$ scan line and the $i^{th}$ scan line of the scan lines overlap.

8. The organic light emitting display as claimed in claim 7, wherein the initialization voltage is supplied to the data lines in a first period where the scan signals overlap and the data signals are supplied to the data lines in a second period where the scan signals do not overlap.

9. The organic light emitting display as claimed in claim 8, wherein the second period is longer in duration than the first period.

10. The organic light emitting display as claimed in claim 7, wherein the initialization voltage is supplied to the data lines in a first period where the scan signals supplied to the $(i-1)^{th}$ scan line and the $i^{th}$ scan line overlap and the data signals are supplied to the data lines in a second period where the scan signals supplied to the $(i-1)^{th}$ scan line and the $i^{th}$ scan line do not overlap.

11. The organic light emitting display as claimed in claim 10, wherein the second period is greater than the first period.

12. An organic light emitting display comprising:

a scan driver configured to supply scan signals to scan lines and to supply emission control signals to emission control lines;

a data driver configured to supply data signals and an initialization voltage to data lines; and pixels positioned at crossing regions of the scan lines and the data lines, each of the pixels comprising:

an organic light emitting diode (OLED);

a first transistor for controlling an amount of current supplied from a first power source, the first transistor having a first electrode coupled to the first power source and a second electrode coupled to the OLED;

a second transistor coupled between the first electrode of the first transistor and a corresponding one of the data lines;

a fourth transistor connected to a node that is connected to both of the first and second transistors;

wherein a gate electrode of the first transistor of a first pixel from among the pixels positioned on an $i^{th}$ ("i" is a positive integer) horizontal line is coupled to a corresponding one of the data lines via a second pixel from among the pixels positioned on an $(i-1)^{th}$ horizontal line in a period where the initialization voltage is supplied to the data lines, wherein the fourth transistor of the first pixel is coupled between the first transistor of the first pixel and a third pixel positioned on an $(i+1)^{th}$ horizontal line, and is configured to be turned on by a corresponding one of the scan signals supplied to an $i^{th}$ scan line, wherein the second transistor of the first pixel is configured to be turned on when a corresponding one of the scan signals is supplied to the $i^{th}$ scan line of the scan lines, and wherein the first pixel further comprises:

a third transistor coupled between the second electrode of the first transistor and the gate electrode of the first transistor and configured to be turned on when the corresponding one of the scan signals is supplied to the $i^{th}$ scan line; and a storage capacitor coupled between the first power source and the gate electrode of the first transistor.

13. The organic light emitting display as claimed in claim 12, wherein the fourth transistor is coupled to the gate electrode of the first transistor of the third pixel positioned on the $(i+1)^{th}$ horizontal line.

14. The organic light emitting display as claimed in claim 12, wherein the first pixel further comprises:

a fifth transistor coupled between the first electrode of the first transistor and the first power source and configured to be turned off when a corresponding one of the emission control signals is supplied to an $i^{th}$ emission control line of the emission control lines; and a sixth transistor coupled between the second electrode of the first transistor and the OLED and configured to be turned off when the corresponding one of the emission control signals is supplied to the $i^{th}$ emission control line.

15. The organic light emitting display as claimed in claim 14, wherein a supply of the corresponding one of the emission control signals to the $i^{th}$ emission control line overlaps the scan signals supplied to the $i^{th}$ scan line and an $(i-1)^{th}$ scan line of the scan lines.

* * * * *